US008787798B2

(12) United States Patent
Tsugihashi

(10) Patent No.: US 8,787,798 B2
(45) Date of Patent: Jul. 22, 2014

(54) PHOTOSENSITIVE DRUM AND VIBRATION REDUCTION METHOD FOR SAME, AND PHOTOSENSITIVE DRUM UNIT

(75) Inventor: Kazuki Tsugihashi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 294 days.

(21) Appl. No.: 13/392,004

(22) PCT Filed: Sep. 9, 2010

(86) PCT No.: PCT/JP2010/065564
§ 371 (c)(1),
(2), (4) Date: Feb. 23, 2012

(87) PCT Pub. No.: WO2011/030840
PCT Pub. Date: Mar. 17, 2011

(65) Prior Publication Data

US 2012/0163865 A1 Jun. 28, 2012

(30) Foreign Application Priority Data

Sep. 11, 2009 (JP) ..... 2009-210635

(51) Int. Cl.
*G03G 15/00* (2006.01)

(52) U.S. Cl.
CPC ..... *G03G 15/751* (2013.01)
USPC ..... 399/159; 399/175; 399/109

(58) Field of Classification Search
USPC ..... 399/159, 175, 109, 179
See application file for complete search history.

(56) References Cited

U.S. PATENT DOCUMENTS

2006/0165436 A1* 7/2006 Nishimura ..... 399/117

FOREIGN PATENT DOCUMENTS

| | | |
|---|---|---|
| JP | 05-158291 | 6/1993 |
| JP | 06-095560 | 4/1994 |
| JP | 10-222011 | 8/1998 |
| JP | 2000-315036 | 11/2000 |
| JP | 2001-249575 | 9/2001 |
| JP | 2003-302870 | 10/2003 |
| JP | 2004-012881 | 1/2004 |
| JP | 2006-119312 | 5/2006 |

OTHER PUBLICATIONS

International Search Report of Application PCT/JP2010/065564 mailed Oct. 12, 2010.
Office Action, from the Japanese Patent Office, issued in corresponding Japanese Patent Application No. 2009-210635, dated Oct. 18, 2011.

* cited by examiner

*Primary Examiner* — Walter L Lindsay, Jr.
*Assistant Examiner* — Roy Y Yi
(74) *Attorney, Agent, or Firm* — Juan Carlos A. Marquez; Morris, Manning & Martin, LLP

(57) ABSTRACT

Disclosed is a photosensitive drum that is provided with a structure that can decrease noise-causing vibrations without being accompanied by the addition of new parts. The photosensitive drum (2) is provided with a tube-shaped conductive base (11) on the surface of which a photosensitive layer (12) is formed, and flanges (13) attached to both ends of the conductive base (11) by being inserted into said both ends. The end sections (13*a*) of the flanges (13) in the tube-length direction (Z) of the conductive base (11) contact the inner surface (11*a*) of the conductive base (11) within an electrically-charged region (Le) of the photosensitive layer (12).

2 Claims, 6 Drawing Sheets

PHOTOSENSITIVE DRUM AND VIBRATION REDUCTION METHOD FOR SAME, AND PHOTOSENSITIVE DRUM UNIT

TECHNICAL FIELD

The present invention relates to a structure and a method for reducing vibrations of a photosensitive drum incorporated in an image forming apparatus, such as a printer, a copier, or a facsimile machine, using an electrophotographic process. In particular, the present invention relates to the structure of the photosensitive drum for reducing noise-causing vibrations and a vibration reducing method for the same.

BACKGROUND ART

Photosensitive drums incorporated into image forming apparatuses, such as printers, copiers, and facsimile machines, are used for electrical charging, exposure, development, and transfer in electrophotographic process. A great number of techniques have already been suggested to reduce vibrations occurring on such a photosensitive drum. For example, techniques as described in Patent Documents 1 and 2 noted below have been suggested.

Patent Document 1 describes a technique in which a stiffness of a cylindrically shaped photosensitive drum is determined in such a manner that a natural frequency of the photosensitive drum becomes higher than a frequency of an exciting force. This is a technology contemplated with a view toward avoiding resonance that occurs when the natural frequency of the photosensitive drum matches with the frequency of the exciting force.

Patent Document 2 describes a photosensitive drum in which a filler such as that formed of aluminum, for example is embedded (refer to FIG. 3 in Patent Document 2). This is a technology contemplated with a view toward increasing a weight and a stiffness of the photosensitive drum by means of the embedded filler, to thereby reduce vibrations of the photosensitive drum.

RELATED ART DOCUMENT

Patent Document

Patent Document 1: Japan Patent Laid-Open Publication No. H10-222011

Patent Document 2: Japan Patent Laid-Open Publication No. H06-95560

SUMMARY OF INVENTION

Problems to be Solved by the Invention

On the other hand, as will be described below in detail, the present inventors have found, as a result of a study conducted on a photosensitive drum to survey a noise thereof, that a primary cause of the noise from the photosensitive drums is a forced vibration of the drum due to an exciting force exerted in association with electrical charging by an electrifier. A fact that a natural frequency of the photosensitive drum is sufficiently higher than a charging frequency has revealed that the resonance in the photosensitive drum is not particularly a matter to be considered as a cause of noise. In other words, there is almost no point in the technology focused on the resonance (natural frequency) of the photosensitive drum as described in Patent Document 1 as a countermeasure against noise of the photosensitive drum.

Then, the technology described in Patent Document 2 is aimed, as described above, at increasing the weight and stiffness of the photosensitive drum to thereby reduce vibrations of the photosensitive drum. Thus, the simply increased weight and stiffness of the photosensitive drum can contribute, as a result, to reduction in the drum vibrations associated with electrical charging. The technology described in Patent Document 2, however, requires insertion of the filler into the photosensitive drum (additional provision of a new component) and fixation of the filler by means of a blowing agent or the like (an additional process step of fixing the new component), leading to an increase in cost of manufacturing the photosensitive drum.

The present invention, which was conceived in view of aforesaid current circumstances, is directed to provide a photosensitive drum equipped with a structure capable of reducing noise-causing vibrations without additional provision of any new component.

Means to Solve the Problems

The present inventors have found that when, using a flange with an elongated inserted section to be inserted into a tube-shaped conductive base, an inner surface of the conductive base is brought into contact with an end section of the flange within an electrically-charged region, a forced vibration of the conductive base due to an exciting force associated with electrical charging can be reduced. Based on this finding, the present invention reached completion.

Specifically, this invention relates to a photosensitive drum comprising a tube-shaped conductive base having a surface on which a photosensitive layer is formed, and a flange inserted from an end of the conductive base so as to be attached to the end, in which the flange is in contact with an inner surface of the conductive base within an electrically-charged region of the conductive base.

According to the above-described configuration, the forced vibration of the conductive base can be minimized by causing the inner surface of the conductive base (the photosensitive drum) to come into contact with the flange within the electrically-charged region. In other words, noise-causing vibrations of the conductive base can be reduced. Moreover, there is no need to use an increased number of parts in manufacturing of the photosensitive drum.

Further, according to a second aspect, the present invention relates to a photosensitive drum unit comprising the above-described photosensitive drum and an electrifier for electrically charging the photosensitive layer. In the photosensitive drum unit, the flange is in contact with the inner surface of the conductive base within a contact region between the photosensitive layer formed on the surface of the conductive base and the electrifier.

According to this configuration, the forced vibration of the conductive base can be minimized by causing the inner surface of the conductive base (the photosensitive drum) to come into contact with the flange within the contact region between the photosensitive layer and the electrifier. This means that the noise-causing vibrations of the conductive base can be reduced. Moreover, it is not necessary to increase the number of parts required for manufacturing the photosensitive drum.

Still further, according to a third aspect, the present invention relates to a method for reducing vibrations of a photosensitive drum comprising a tube-shaped conductive base having a surface on which a photosensitive layer is formed, and a flange attached to an end of the conductive base. The method for reducing vibrations of a photosensitive drum comprises inserting the flange from the end of the conductive base and bringing the flange into contact with an inner surface of the conductive base within an electrically-charged region of the conductive base, to thereby reduce a forced vibration of the conductive base resulting from an exciting force associated with electrical charging.

Furthermore, in the present invention, the flange is preferably brought into contact with the inner surface of the conductive base within the contact region between the photosensitive layer formed on the surface of the conductive base and an electrifier for electrically charging the photosensitive layer.

Effects of the Invention

According to this invention, a photosensitive drum can be provided in which noise-causing vibrations can be reduced to an extent matching or beyond that achieved by conventional technologies without accompanying additional provision of any new component.

EMBODIMENT FOR CARRYING OUT THE INVENTION

Figure 1:
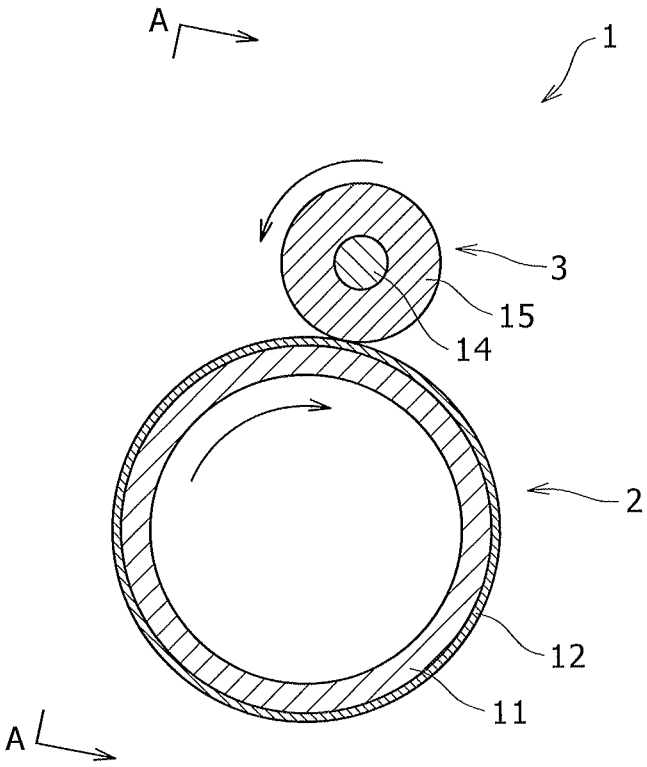
FIG. 1 is a cross sectional view of a photosensitive drum unit equipped with a photosensitive drum according to an embodiment of this invention.
Figure 2B:
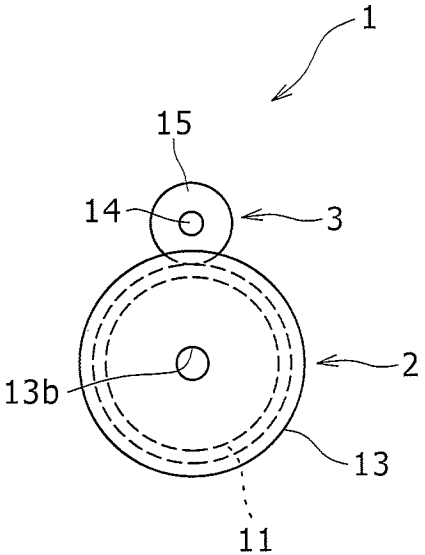
FIG. 2 (*a*) is a view taken along an A-A arrow in FIG. 1 and FIG. 2 (*b*) is a view taken along a B-B arrow in FIG. 2 (*a*)
Figure 2A:
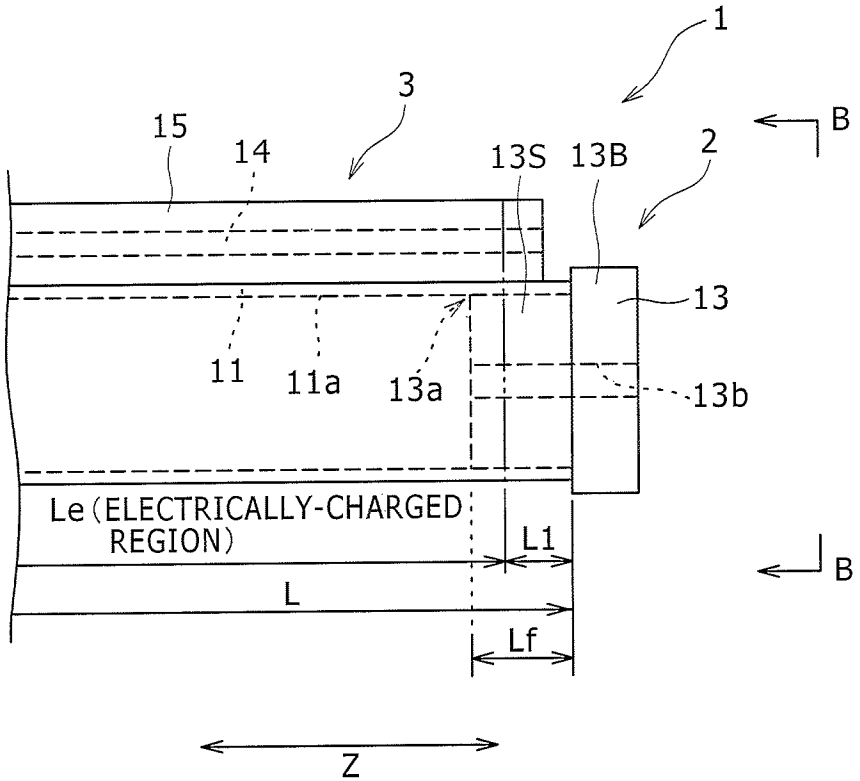

Hereinafter, embodiments of the present invention will be described with reference to the drawings. FIG. 1 is a cross sectional view of a photosensitive drum unit 1 equipped with a photosensitive drum 2 according to an embodiment of this invention. FIG. 2(*a*) is a view (a front view of the photosensitive drum unit 1) taken along an A-A arrow in FIG. 1. Further, FIG. 2(*b*) is a view (a side view of the photosensitive drum unit 1) taken along a B-B arrow in FIG. 2(*a*).

(Structure of Photosensitive Drum Unit)

As shown in FIG. 1, the photosensitive drum unit 1 is a contact electrification type of a photosensitive drum unit equipped with the photosensitive drum 2 and a charging roller 3 (an electrifier). It should be noted that the present invention is also applicable to a non-contact electrification type of the photosensitive drum unit using corona discharge or the like.

(Charging Roller)

The charging roller 3 includes a conductive core bar 14 and a conductive elastic layer 15 formed on an outer circumference of the conductive core bar 14. The conductive core bar 14 is a rod-shaped body composed of a conductive material such as iron or stainless steal. The conductive elastic layer 15 is a tube-shaped layer composed of a conductive material such as carbon containing urethane. The charging roller 3 is followingly rotated by rotation of the photosensitive drum 2. In other words, the charging roller 3 is in contact with the photosensitive drum 2. A photosensitive layer 12, which will be described further below, is electrically charged in a contact process by the charging roller 3. Note that an electrifier other than the charging roller 3 may be used, including, for example, electrifiers of a brush type or a blade type.

(Photosensitive Drum)

The photosensitive drum 2 comprises a tube-shaped conductive base 11 having a surface on which the photosensitive layer 12 is formed, and two flanges 13 which are inserted from both ends of the conductive base 11 and attached to the both ends respectively. As shown in FIG. 1, the photosensitive drum 2 is rotatively driven, for example, in a clockwise direction at a predetermined peripheral velocity. It should be noted that the flange 13 may be attached only to either one of the both ends of the conductive base 11.

(Conductive Base)

The tube-shaped conductive base 11 is composed of an aluminum pipe. Here, the conductive base 11 can be made of any conductive material, and may be composed of, for example, a stainless pipe. A diameter of the conductive base 11 is greater than a diameter of the charging roller 3.

The photosensitive layer 12 formed on the surface of the conductive base 11 is, for example, an organic photosensitive layer. The photosensitive layer 12 is formed on the entire circumference of the conductive base 11. In a tube-length direction Z, the photosensitive layer 12 is formed from one end of the conductive base 11 to the other end thereof. The photosensitive layer 12 is negatively or positively charged by the charging roller 3.

(Electrically-Charged Region)

In order to uniformly charge the photosensitive layer 12, a voltage in which a DC voltage is superimposed on an AC voltage is applied to the charging roller 3. Upon application of the voltage to the charging roller 3, an attractive force caused by an electrostatic force acts between the photosensitive drum 2 (conductive base 11) and the charging roller 3. Because the magnitude of the attractive force is periodically changed, the photosensitive drum 2 (conductive base 11) is caused to vibrate. The attractive force that is periodically changed due to the electrostatic force functions as an exciting force associated with electrical charging. Vibrations of the photosensitive drum 2 (conductive base 11) induced by the exciting force is a cause of noise that accompanies the electrical charging. A frequency of the above-described AC voltage applied to the charging roller 3 is a charging frequency.

In this invention, the electrically-charged region means a region (a range) to be electrostatically charged directly by the charging roller 3. In other words, a region (a range) in the conductive base 11 where the above-described attractive force acts between the photosensitive drum 2 (conductive base 11) and the charging roller 3 (an electrifier) functions as the electrically-charged region. More specifically, a region where the photosensitive layer 12 formed on the surface of the conductive base 11 is directly caused to become electrostatically charged (to receive the exciting force) by the charging roller 3 (electrifier) is the electrically-charged region. The electrically-charged region is determined depending on a mutual position relationship between the conductive base 11 and the charging roller 3, a region (a range) of the charging roller 3 in which an electrostatic force is generated, and others.

As shown in FIG. 2 (*a*), the electrically-charged region Le in this embodiment corresponds, in the tube length direction Z of the conductive base 11, to a central region (range) from which both end sections (length L1 portions) of the conductive base 11 are excluded. On the other hand, in a circumferential direction (a direction of rotation) of the conductive base 11, the entire circumferential region (range) functions as the electrically-charged region. It should be noted that the photosensitive layer 12 is not illustrated in FIGS. 2 (*a*) and (*b*).

Meanwhile, in a case where the electrostatic force (exciting force) is generated on the entire length of the charging roller 3, both end positions of the electrically-charged region Le coincide with both end positions of the charging roller 3 (electrifier). In this case, the both end positions of the electrically-charged region Le are aligned with a contact region between the photosensitive layer 12 formed on the conductive base 11 and the charging roller 3.

(Flange)

The flanges 13 are designed to support the conductive base 11 on both ends thereof, and composed of a resin material, such as, for example, an ABS resin. As shown in FIG. 2(*a*), the flange 13 of this embodiment has a large diameter part 13B and a small diameter part 13S. The large diameter part 13B and the small diameter part 13S are concentrically formed, and the small diameter part 13S is extended from an end of the large diameter part 13B. A through hole 13*b* is formed in a radial center region of the flange 13. A shaft (not illustrated) is inserted into the through hole 13*b*. The flange 13 can, in some cases, have teeth formed on an outer circumferential surface of the large diameter part 13B so as to function as a gear for rotatively driving the conductive base 11.

An outer diameter of the small diameter part 13S of the flange 13 is substantially equal to an inner diameter of the conductive base 11. After the small diameter part 13S of the flange 13 is inserted from the end of the conductive base 11 into the inside thereof, the outer circumferential surface of the small diameter part 13S and an inner surface 11*a* of the conductive base 11 are bonded by means of an adhesive applied therebetween or by other means, to thereby secure the flanges 13 to both ends of the conductive base 11, respectively.

Then, in the tube-length direction Z of the conductive base 11, an end section 13*a* of the flange 13 is in contact with the inner surface 11*a* of the conductive base 11 within the electrically-charged region Le. To put it in another way, a length Lf of the small diameter part 13S (the length of an inserted section) of the flange 13 is defined in such a manner that the end section 13*a* is brought into contact with the inner surface 11*a* of the conductive base 11 within the electrically-charged region Le (along the tube-length direction Z).

When the inner surface 11*a* of the conductive base 11 is caused to make contact with the end section 13*a* of the flange 13 within the electrically-charged region Le, the amplitude of a forced vibration of the conductive base 11 due to the exciting force associated with electrical charging becomes smaller than that conventionally associated with the electrical charging. That is, noise-causing vibrations of the conductive base 11 can be reduced. Note that according to the photosensitive drum 2 of this embodiment, there is no need to increase the number of components from that of conventional components for producing the photosensitive drum 2. This means that because additional provision of any new component is not required for taking a countermeasure against noise of the photosensitive drum, material, manufacturing, and assembling costs can be prevented from increasing in production of the photosensitive drum.

Further, in this embodiment, the entire outer circumferential surface of the small diameter part 13S along the circumferential direction (direction of rotation) and the inner surface 11*a* of the conductive base 11 are in contact with each other and fixed together through adhesion. In this way, the conductive base 11 can be firmly fixed to the flange 13. Still further, in terms of productivity improvement in process steps of inserting and bonding the flange 13 into the conductive base 11, the surface of the small diameter part 13S of the flange 13 may be provided with a grove or a notch extended along an insertion direction or the circumferential direction, or an outer circumference edge of the small diameter part 13S may be chamfered.

In this connection, the end section 13*a* of the flange 13 not only includes an end edge of the flange 13 but also includes vicinities of the end edge of the flange 13. More specifically, in a case where the outer circumference edge of the small diameter part 13S is chamfered, although the end itself of the flange 13 does not make contact with the inner surface 11*a* of the conductive base 11, the end section 13*a* of the flange 13 may be defined including a region which is in contact with the inner surface 11*a* of the conductive base 11.

EXAMPLE 1

Due to a reduced physical size of recent image forming apparatuses, a photosensitive drum having a diameter of 30 mm or smaller is often used as the photosensitive drum to be incorporated into such an image forming apparatus. With this in view, the present inventors conducted a study aimed at the photosensitive drum 2 in which an aluminum pipe of 24 mm in outer diameter is used as the conductive base 11 to investigate the cause of noise of the photosensitive drum 2 and verify an effect of the countermeasure against noise by means of a numerical analysis based on a finite element method. The aluminum pipe (conductive base 11) is 246 mm in length L and 0.75 mm in plate thickness. Further, L1 shown in FIG. 2(*a*) is 10 mm. Namely, a region that lies on a center side of locations which are respectively situated at a distance of 10 mm from both ends of the conductive base 11 in the tube-length direction Z and measures 226 mm in length constitutes the electrically-charged region Le.

(Natural Frequency)

Figure 3:
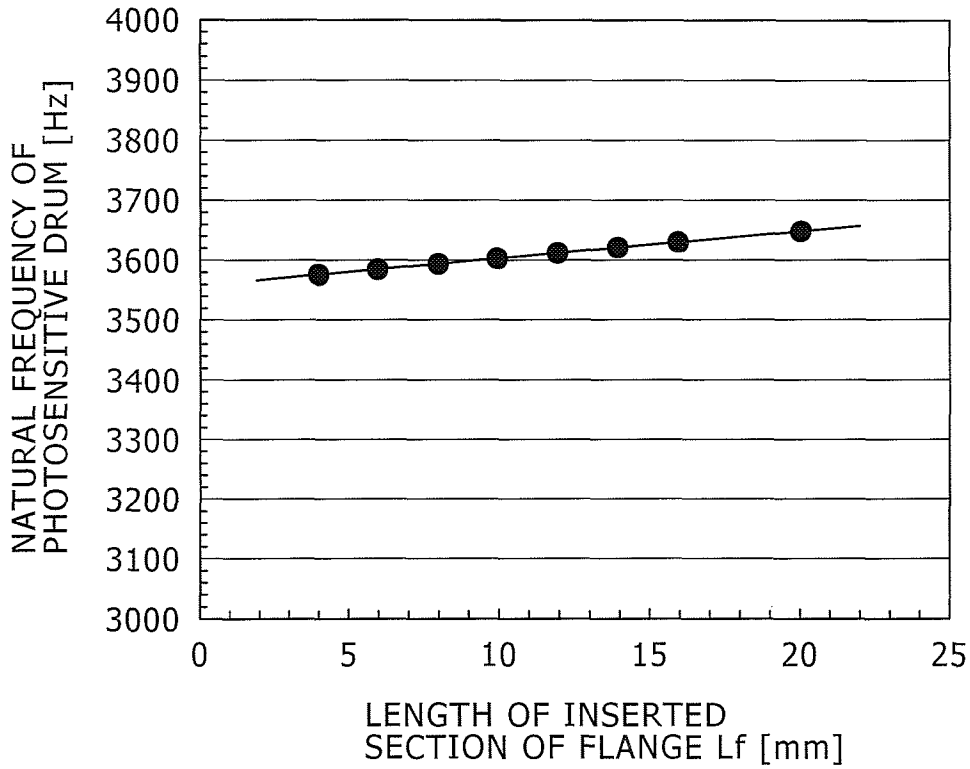
FIG. 3 is a graph showing a relationship between a length of an inserted section of a flange and a natural frequency of a photosensitive drum.

FIG. 3 shows a result of analyzing natural frequencies of the photosensitive drum 2 obtained while changing the length Lf of the small diameter part 13S (the length Lf of the inserted section) of the flange 13. FIG. 3 is a graph showing a relationship between the length Lf of the inserted section of the flange 13 and the natural frequency of the photosensitive drum 2. Note that only the conductive base 11 was modeled in a numerical model used for the finite element analysis. With respect to the flange 13, on the other hand, by constraining a displacement in a region of the conductive base 11 corresponding to the contact position between the inner surface 11*a* of the modeled conductive base 11 and the flange 13, the change in length Lf of the small diameter part 13S of the flange 13 was simulated.

The length Lf of the inserted section of the flange 13 was changed to 4 mm, 6 mm, 8 mm, 10 mm, 12 mm, 14 mm, 16 mm, and 20 mm, and the natural frequencies of the photosensitive drum 2 were analyzed for each length. It should be noted that the charging frequency of the photosensitive drum 2 is approximately 1200 Hz. As can be seen from FIG. 3, it has been found that the natural frequencies of the photosensitive drum 2 are, in any case, sufficiently higher than the charging frequency (of 1200 Hz, for example) regardless of the length Lf of inserted section of the flange 13. This means that the resonance of the photosensitive drum 2 (matching between the natural frequency and the charging frequency) does not particularly become a problem as a cause of noise. Thus, any countermeasure aimed at increasing the natural frequency does not contribute to noise reduction. In this way, the present inventors have found that the primary cause of noise from the photosensitive drum 2 is the forced vibration of the drum due to the exciting force exerted in association with electrical charging by the electrifier (such as the charging roller 3, for example).

In addition, the natural frequency of the photosensitive drum 2 tended to slightly increase as the length Lf of the inserted section of the flange 13 became greater, but underwent no substantial change.

(Vibration Reduction Method for Photosensitive Drum)

As described above, the present inventors have found that the primary cause of noise from the photosensitive drum 2 is the forced vibration of the drum due to the exciting force exerted in association with the electrical charging by the electrifier (the charging drum 3, for example). Then, employing the flange 13 which has an extended length Lf of the section inserted into the tube-shaped conductive base 11, the present inventors inserted the flanges 13 from each end of the conductive base 11. As a result, within the electrically-charged region Le (and thus within the contact region between the photosensitive layer formed on the surface of the conductive base 11 and the charging roller 3), the end section 13*a* of the flange 13 is brought into contact with the inner surface 11*a* of the conductive base 11, to thereby reduce the forced vibration of the conductive base 11 caused by the exciting force associated with the electrical charging.

(Amplitude of Forced Vibration)

Figure 4:
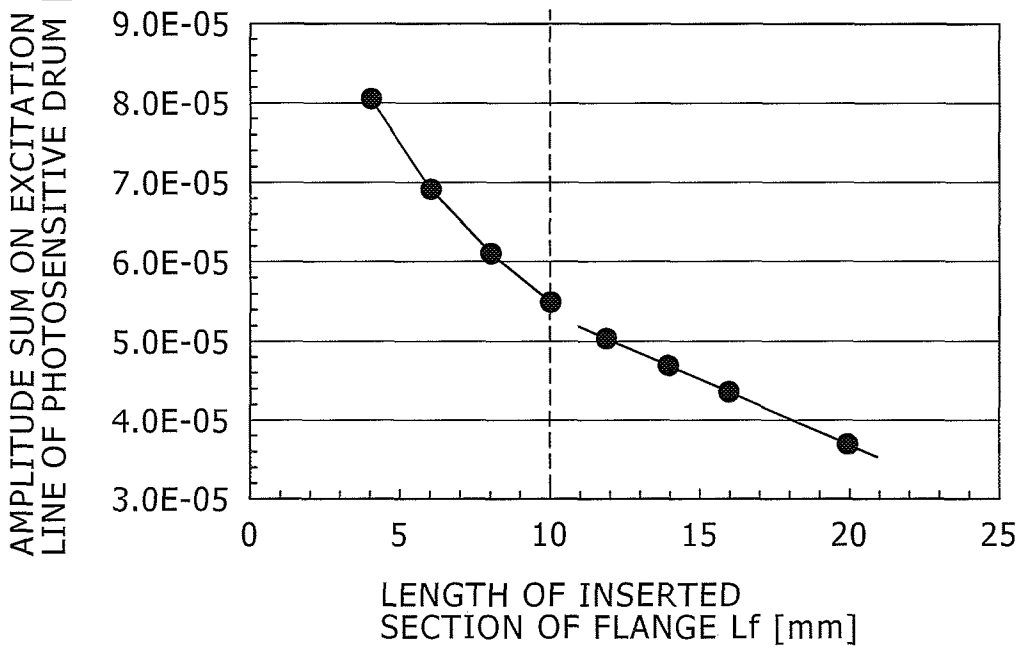
FIG. 4 is a graph showing a relationship between the length of the inserted section and a summation of amplitudes of forced vibration on an excitation line of the photosensitive drum.

An analysis was conducted on the forced vibration of the conductive base 11 (photosensitive drum 2) caused by the exciting force associated with the electrical charging. The result of the analysis is shown in FIG. 4. FIG. 4 is a graph showing a relationship between the length Lf of the inserted section of the flange 13 and a summation of amplitudes of the forced vibration on a excitation line (which will be described below) of the photosensitive drum 2.

Regarding the exciting force associated with the electrical charging, a condition that an exciting force of 1 N in total (the maximum value of the periodically changing exciting force) linearly and uniformly acts on the electrically-charged region Le of a 226 mm length was established. The length Lf of the inserted section of the flange 13 was changed to 4 mm, 6 mm, 8 mm, 10 mm, 12 mm, 14 mm, 16 mm, and 20 mm, and deformation of the photosensitive drum 2 caused by the forced vibrations was analyzed for each length. The amounts of deformation (amplitudes) obtained as a result of the analysis, which are not uniform in the electrically-charged region Le, have a distribution with, on the excitation line of the photosensitive drum 2, the maximum situated on a central section of the electrically-charged region Le and the minimum situated on the end section of the electrically-charged region Le. FIG. 4 shows the summation of the amplitudes. Here, the numerical model is created in the same manner as that used in the above-described analysis of the natural frequency.

As can be seen from FIG. 4, the amplitude of the photosensitive drum 2 decreases, as the length Lf of the inserted section of the flange 13 becomes greater. Here, the slope of the graph changes where length Lf of the inserted section of the flange 13 reaches approximately 10 mm. When Lf=10 mm, the end section 13*a* of the flange 13 is located at an end of the electrically-charged region Le. When Lf reaches or exceeds 10 mm, the slope of the graph becomes relatively smaller than that in a case where Lf<10 mm. When the length Lf of the inserted section is smaller than 10 mm, the increase in amplitude of the forced vibration becomes more drastic as the length Lf of the inserted section is reduced. That is, when the length Lf of the inserted section is defined as Lf≥10 mm, and the inner surface 11*a* of the conductive base 11 is brought in contact with the end section 13*a* of the flange 13 within the electrically-charged region Le, the noise-causing forced vibration of the conductive base 11 (photosensitive drum 2) can be reduced with stability. In other words, even when manufacturing errors are caused in the length Lf of the inserted section of the flange 13, as long as the length Lf of the inserted section is 10 mm or greater, the amplitude of the forced vibration of the photosensitive drum 2 can be reduced in a stable way to an amplitude smaller than that obtained when Lf<10 mM.

In addition, it is preferable that the length Lf of the inserted section of the flange 13 is not less than 10 mm and not more than 20 mm. In other words, it is desirable to bring the end section 13*a* of the flange 13 into contact with the inner surface 11*a* of the conductive base 11 in a region between the end of the electrically-charged region Le and the location at a distance of 10 mm ((20-10) mm) from the end of the electrically-charged region Le toward the center of the conductive base 11. The level of noise reduction whereby a lot of people is able to perceive the effect of noise reduction is 6 dB, and the noise reduction of this level corresponds to reduction of noise energy to one-fourth achieved by decreasing the amplitude of the forced vibration to one-half. When a conventional length of the inserted section is taken as 4 mm, the length Lf of the inserted section should be 20 mm to decrease the amplitude by one-half.

EXAMPLE 2

Figure 5:
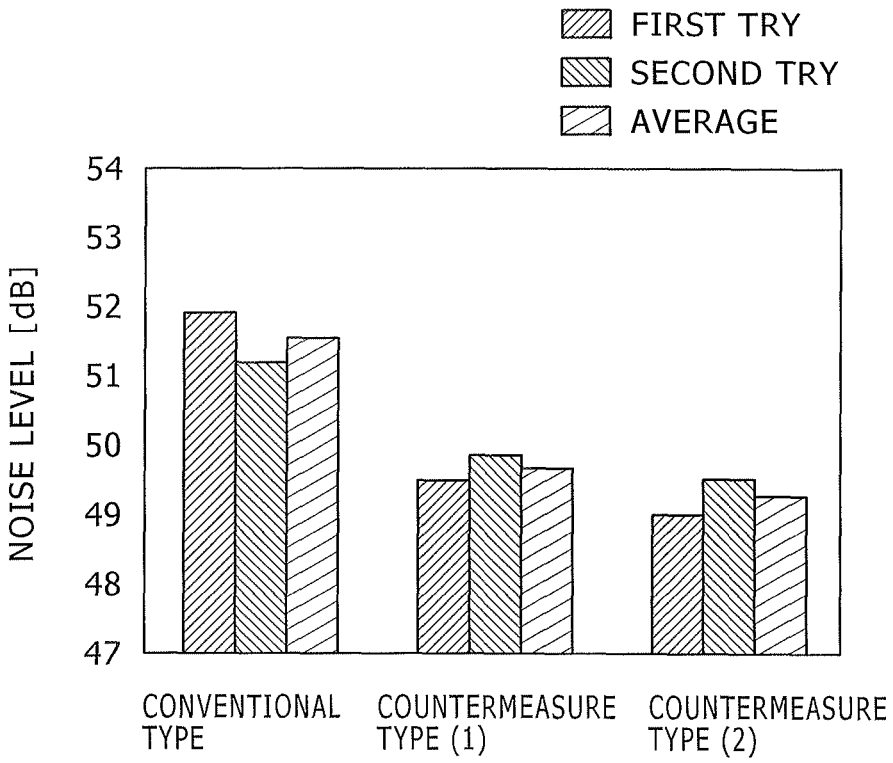
FIG. 5 is a graph showing results of experimentally verifying effects of the invention (evaluation results obtained using an actual printer)

Using, as a subject of measurement, actual equipment of a printer including the photosensitive drum 2 and the electrically-charged region Le which are the same as those of the above-described example 1, the noise was actually measured to verify effectiveness of the present invention. The measurement was carried out on a site located at a distance of 20 cm from a rear surface of a printer body having a size of about 37 cm width×21 cm height×23 cm depth and at a height of 20 cm from a floor on which the printer is installed, to find a level of the noise (a component having a frequency equal to the charging frequency in the noise) caused by electrical charging for printing. The measurement was carried out twice for each printer of a conventional type and countermeasure types (1), (2). FIG. 5 shows results of measurement.

In FIG. 5, the length Lf of the inserted section of the conventional type is 4 mm. Although both of the countermeasure types (1) and (2) have the length Lf of the inserted section which is 15 mm, the measurement was carried out on two test pieces with consideration of variations in the test pieces. Meanwhile, in both the conventional type and the countermeasure types (1), (2), the length corresponding to L1 in FIG. 2 (*a*) is 10 mm while the flange made of plastic has the small diameter section of 1.5 mm in thickness. Accordingly, in the conventional type, the inner surface of the conductive base is not supported within the electrically-charged region.

When average values of the two measurements are compared, the effect of noise reduction of 1.9 db in the test piece (1) and 2.3 dB in the test piece (2) relative to the conventional type have been proved. As such, evaluation conducted on the actual equipment has demonstrated that the noise associated with the electrical charging can be reduced at low cost without additional provision of any new component according to the present invention.

(Exemplary Modification of Flange)

Figure 6:
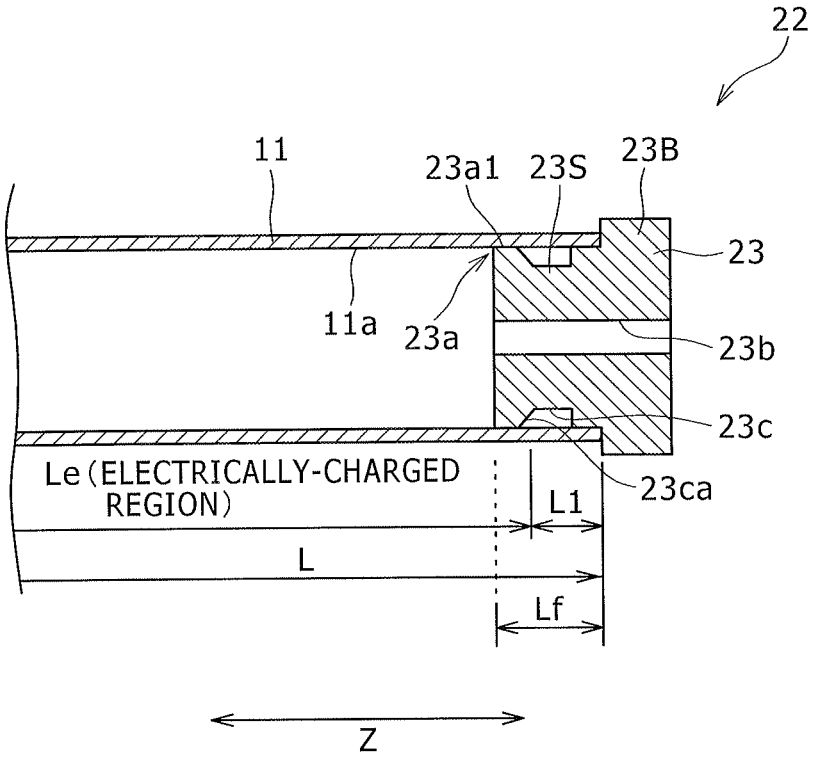
FIG. 6 is a cross sectional view of a photosensitive drum illustrating an exemplary modification of the flange.

FIG. 6 is a cross sectional view of a photosensitive drum 22 illustrating an exemplary modification of the flange 13 for the photosensitive drum 2 shown in FIG. 2. It should be noted that illustration of the photosensitive layer is omitted from FIG. 6.

A flange 23 according to the exemplary modification shown in FIG. 6 has a large diameter part 23B and a small diameter part 23S. The large diameter part 23B and the small diameter part 23S are concentrically formed, and the small diameter part 23S is extended from an end of the large diameter part 23B. A through hole 23*b* is formed in a radial center of the flange 23. In this regard, the flange 23 according to the exemplary modification is identical with the flange 13 illustrated in FIG. 2.

A difference between the flange 23 according to the exemplary modification and the flange 13 illustrated in FIG. 2 is that a groove 23*c* extended along the direction of rotation is formed on an outer circumferential surface of the small diameter part 23S in the flange 23. The groove 23*c* is annularly formed around the entire circumference of the small diameter part 23S along the direction of rotation. The groove 23*c* has a trapezoidal shape in cross section. Note that the cross sectional geometry is not necessarily the trapezoidal shape.

The groove 23*c* has an inclined surface 23*ca* which is designed to change the depth (a radial dimension) along a direction away from a large diameter part 23B side. In this way, an end section 23*a* of the flange 23 is thickened on a center side along the radial direction. In addition, an outer circumferential surface 23*a*1 of the end section 23*a* in the flange 23 partitioned by the groove 23*c* is entirely located within the electrically-charged region Le. Then, the entire face of the outer circumferential surface 23*a*1 is in contact with the inner surface 11*a* of the conductive base 11 within the electrically-charged region Le. Consequently, a supporting force of the flange 23 which supports each end of the conductive base 11 within the electrically-charged region Le can be sufficiently secured. Still further, the groove 23*c* facilitates insertion of the flange 23 into the conductive base 11.

Although the embodiment of the present invention has been described above, the present invention is not limited to the above embodiment, and may be implemented in various modified forms without departing from the scope described in the claims. This application is based on a Japan Patent Application (JPA No. 2009-210635) filed on Sep. 11, 2009, which is incorporated herein by reference in its entirety.

DESIGNATION OF REFERENCE CHARACTERS

1: photosensitive drum unit
2: photosensitive drum
3: charging roller
11: conductive base
11*a*: inner surface of conductive base
12: photosensitive layer
13: flange
13*a*: end section of flange
Le: electrically-charged region

The invention claimed is:

1. A photosensitive drum unit, comprising:

a photosensitive drum having a tube-shaped conductive base with a surface on which a photosensitive layer is formed, and a flange inserted from an end of said conductive base and attached to the end; and an electrifier for electrically charging the photosensitive layer, wherein the flange is in contact with an inner surface of the conductive base within a contact region between the photosensitive layer formed on the surface of the conductive base and said electrifier.

2. A method for reducing vibrations of a photosensitive drum comprising a tube-shaped conductive base having a surface on which a photosensitive layer is formed, and a flange attached to an end of the conductive base, wherein the method comprises:

inserting the flange from the end of the conductive base, and bringing the flange into contact with an inner surface of the conductive base within an electrically-charged region of the conductive base to thereby reduce a forced vibration of the conductive base resulting from an exciting force associated with electrical charging, wherein the flange is brought into contact with the inner surface of the conductive base within the contact region between the photosensitive layer formed on the surface of the conductive base and an electrifier for electrically charging the photosensitive layer.

* * * * *